United States Patent [19]

Goodwin

[11] 4,280,794

[45] Jul. 28, 1981

[54] SACRIFICIAL ANODIC PROTECTOR KIT FOR A PROPELLER SHAFT

[76] Inventor: Wendell W. Goodwin, 4702 Coldbrook Ave., Lakewood, Calif. 90713

[21] Appl. No.: 21,334

[22] Filed: Mar. 19, 1979

[51] Int. Cl.[3] ..... B63H 23/34

[52] U.S. Cl. ..... 416/146 R; 416/245 A

[58] Field of Search ..... 416/146 R, 146 B, 146 A, 416/245 A, 142, 244 B, 208; 403/344, 269

[56] References Cited

U.S. PATENT DOCUMENTS

| | | | |
|---|---|---|---|
| 1,609,724 | 12/1926 | Kendall | 403/269 X |
| 2,067,839 | 1/1937 | Godfrey | 416/146 B X |
| 2,351,356 | 6/1944 | Meyer | 416/146 B X |
| 2,732,021 | 1/1956 | Taft | 416/245 A |
| 3,169,105 | 2/1965 | Preiser et al. | 416/245 A X |
| 3,591,311 | 7/1971 | Butler | 416/142 A |
| 3,868,193 | 2/1974 | Schott | 403/344 |
| 4,077,742 | 3/1978 | Goodwin | 416/245 A |

FOREIGN PATENT DOCUMENTS

| | | | |
|---|---|---|---|
| 906054 | 7/1972 | Canada | 416/146 B |
| 107196 | 12/1918 | United Kingdom | 416/244 B |

*Primary Examiner*—Everette A. Powell, Jr.
*Attorney, Agent, or Firm*—Sellers and Brace

[57] ABSTRACT

A sacrificial anodic protector kit for propeller shafts comprising a split zinc collar having a copper layer on its interior surface. The collar is clampable about a propeller shaft by machine screws mateable with nuts embedded in the collar.

2 Claims, 3 Drawing Figures

SACRIFICIAL ANODIC PROTECTOR KIT FOR A PROPELLER SHAFT

This invention relates to a protector kit for submerged boat hardware, and more particularly to a sacrificial anodic protector kit adapted to be assembled about a propeller shaft to protect the shaft and other hardware in the vicinity thereof from galvanic action of sea water.

It is well known that metallic fittings including steel, brass and bronze fittings submerged in sea water are subject to electro chemical and galvanic attack causing these components to be corroded and to fail prematurely. Proposals to safeguard hardware against these hazards have been made heretofore. These proposals include sacrificial components clampable to boat hardware in an area subject to preferential corrosion when these parts are submerged in sea water. Such prior sacrificial components have included a zinc collar mountable about a propeller shaft as well as a zinc nose cone on the outer end of the shaft. Though types of protectors have been helpful and have served useful purposes each is subject to shortcomings and disadvantages. These disadvantages as respects prior sacrificial nose cones were overcome by the construction disclosed in my U.S. Pat. No. 4,077,742 granted Mar. 7, 1978.

It is the purpose of this invention to overcome the shortcomings of prior sacrificial anodic collars. Such prior collars are subject to corrosion on all surfaces including the inner surface in contact with the propeller shaft. This layer of corrosion has been found to interfere seriously with the electrical conductivity between the collar and the shaft and the operating effectiveness of the collar. Another shortcoming was reliance on non-captive conventional nut and bolt type fasteners to hold the collars assembled to the shaft. In consequence it was a frustrating operation to assemble the collars to a shaft without removing the boat from the water or into dry docking facilities.

SUMMARY OF THE INVENTION

This invention overcomes the shortcomings and disadvantages of prior art sacrificial collars in two important respects. Firstly, the interior surface of the collar is provided with an excellent conductive layer of copper which is immune to attack by salt water and which continues to provide an excellent conductive path between the zinc and the propeller shaft throughout the service life of the collar. Secondly, non-corrosive fastener nuts are captively embedded in the collar in position to receive threaded machine screws thereby enabling a workman to hold the collar halves assembled about a submerged shaft with one hand while inserting and starting first one and then another of the machine screws with the other hand. This operation is readily carried out with the aid of a diving helmet without need for removing the boat from the water. Once a single machine screw has been started the remaining machine screws may be inserted and in turn tightened.

Accordingly it is a primary object of this invention to provide an improved sacrificial anodic protector kit comprising a split collar securable about a propeller shaft and embodying a unique expedient for reducing the area subject to attack and maintaining the zinc component in excellent electrical contact with the shaft throughout the life of the collar.

Another object of the invention is the provision of a sacrificial anodic protective kit made in two semi-cylindrical halves and having a coating of good electrical conductive material on its shaft engaging surface substantially immune to attack by sea water.

Another object of the invention is the provision of an improved anodic protector kit comprising a zinc collar made in two halves electro-plated on its interior surface with copper and having fastener nuts captively embedded in the zinc main body.

These and other more specific objects will appear upon reading the following specification and claims and upon considering in connection therewith the attached drawing to which they relate.

Referring now to the drawing in which a preferred embodiment of the invention is illustrated:

Figure 1:
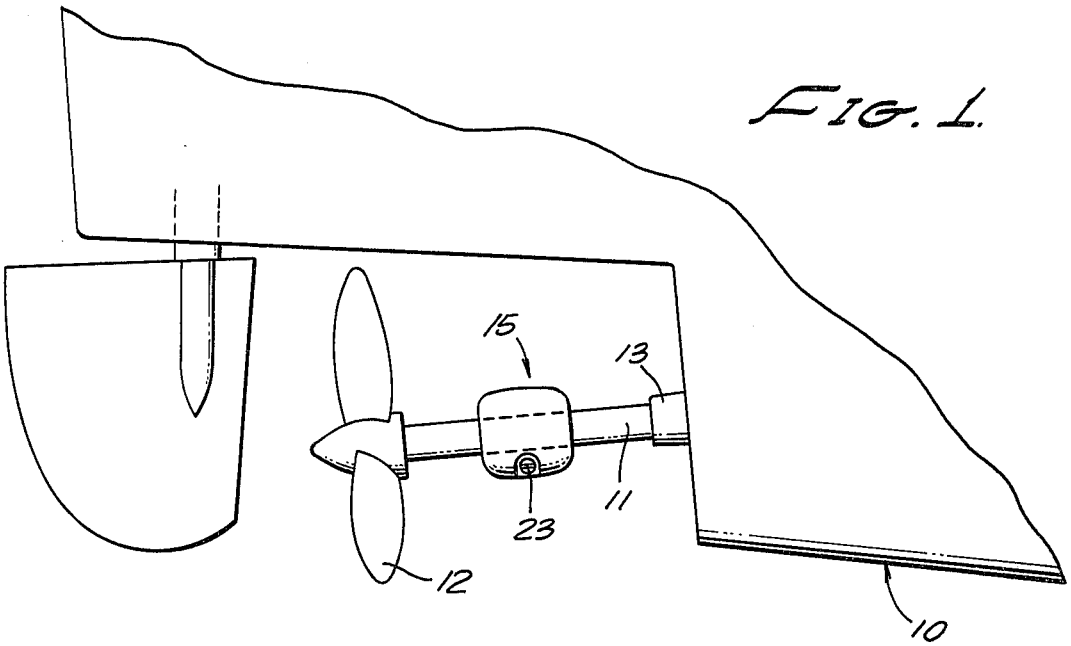
FIG. 1 is a fragmentary side elevational view of the lower stern corner of a boat showing an illustrative embodiment of the unique sacrificial collar installed on the propeller shaft.
Figure 2:
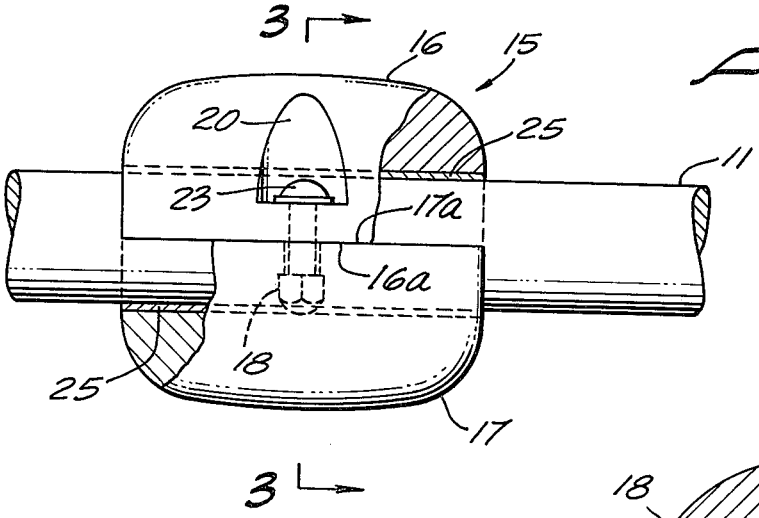
FIG. 2 is a fragmentary view on an enlarged scale of the sacrificial collar.
Figure 3:
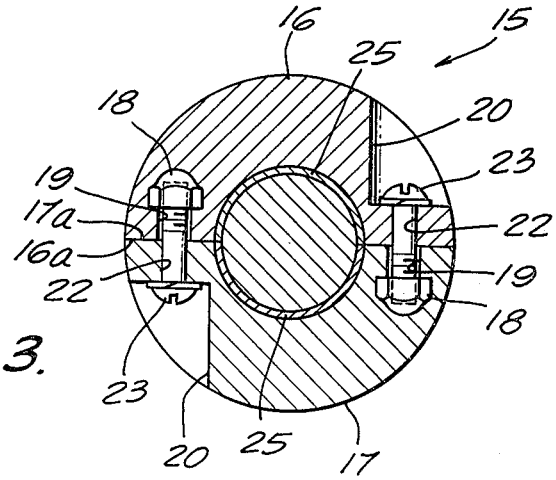
FIG. 3 is a cross sectional view taken along line 3—3 on FIG. 2.

Referring initially more particularly to FIG. 1, there is shown the lower stern corner of a boat hull 10 having a propeller shaft 11 projecting through the hull and equipped with a typical propeller 12 at its outer end. Shaft 11 is supported in a fluid tight bearing assembly 13 secured in known manner to the hull. Snugly assembled about the propeller shaft in an area between propeller 12 and bearing assembly 13 is a sacrificial anodic collar 15 embodying the features of this invention.

Collar 15 comprises an elongated thick walled zinc ring cast in two identical semi-cylindrical halves 16 and 17 having planar mating surfaces 16*a*, 17*a* lying in a diametric plane through the collar. Each half is cast with an acorn nut 18 embedded therein with its threads aligned with a machine screw receiving well 19 opening through the associated one of the mating surfaces 16*a*, 17*a*. The exterior of each collar half is also provided with at least one L-shaped recess 20 disposed opposite a respective nut 18 of the mating half of the collar. Opening through the bottom of each recess 20 is a bore 22 to receive the shank of a machine screw 23 mateable with nut 18.

An important feature of the invention is the provision of a copper layer 25 strongly and intimately adhered to the interior surface of each of the collar halves 16 and 17 A preferred mode of forming the copper layer is by electro deposition of copper on the surface to be coated while the zinc castings are submerged in an electrolytic bath. This operation may be carried out by mounting one or more of the collar halves in a sponge rubber support contoured to fit about the exterior surfaces of the collars and including resilient non-conductive strips suitably held pressed against the surfaces 16*a* and 17*a* thereby excluding contact of the electrolyte from all surfaces except the semi-cylindrical interior surface to be plated with copper. This carrier assembly so prepared is then submerged in the electrolyte and the electroplating operation is carried out in accordance with known plating technique to deposit a copper film or layer 25 of suitable thickness along the entire inwardly facing surface. A layer of one half to three mils or more in thickness provides excellent results. Upon removal from the electrolyte the collars are in readiness for assembly to a propeller shaft.

It will be recognized from the foregoing description of collar 15 that its components comprise a kit consisting of the two halves 16 and 17 and at least two machine screws 23. In larger embodiments and particularly where the collar is made in lengths longer than that depicted in the drawing, more than one set of fasteners may be provided along each side.

It will be recognised from the foregoing that the invention sacrificial collar kit comprises a minimum number of components readily assembled about a propeller shaft. This operation may be carried out without need for removing the boat from the water and with a minimum risk of dropping any component. The portion of the propeller shaft 11 to be embraced by the collar is preferably thoroughly cleaned with abrasive material such as emery cloth, steel wool, or the like. Thereafter the two collar halves are assembled about the shaft and held in place with one hand while the other is used to insert a machine screw 23 into mating relation with the associated one of nuts 18. After this fastener has been engaged with the nut threads the other or remaining ones of the machine screws are assembled in turn. It is then a simple matter to thoroughly and firmly tighten each of the machine screws thereby clamping the conductive copper layer 25 into intimate frictional and electrical contact with the clean surface of propeller shaft 11. The assembled collar then functions in known manner to protect shaft 11, propeller 12, bearing assembly 13, as well as any other adjacent metal material from electrolytic and galvanic action of sea water. In carrying out this protective function the inexpensive and replaceable zinc body of collar 15 is sacrificed in known manner thereby protecting boat hardware components from electrochemical and galvanic attack.

While the particular sacrificial anodic protector kit for a propeller shaft herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A sacrificial anodic protector kit adapted for assembly to a propeller shaft to protect the same from elecrolytic attack consisting of:

a cast zinc collar having a cylindrical inner surface, said collar being split diametrically lengthwise thereof into two similar halves having a plurality of threaded nuts embedded therein inwardly of the mating surfaces of said halves and each aligned with a respective bore opening through said mating surfaces of said halves when assembled about a normally submerged portion of a propeller shaft;

the semi-cylindrical inner surface of said collar halves each being coated from end-to-end thereof with an electroplated copper layer, to a thickness of about 0.5 to 3 mils; and separate machine screws insertable through respective ones of said bores and wrenchable into an associated one of said nuts to clamp said zinc castings to a propeller shaft with said copper layers in intimate electrical contact therewith.

2. A sacrificial anodic collar kit adapted for assembly to a propeller shaft between a boat hull and a propeller mounted on the outer end thereof, said kit comprising:

an annular cast zinc collar split into two halves along a longitudinal diametric plane;

said cast halves having at least two sets of aligned fastener bores lying normal to and intersected by said diametric plane with one set spaced to either side of the axis of said collar and one bore of each set opening through the outer surface of said collar half, and the inner semi-cylindrical surfaces of said collar halves including an electro-plated layer of copper having a thickness of the order of 0.5 to 3 mils;

a nut and screw for each set of said fastener bores, said nuts being fully and captively embedded in one of said collar halves entirely below said diametric plane and at the bottom of one of said aligned sets of bores with the threads thereof exposed and positioned to mate with the threads of one of said screws whereby said collar is adapted to be assembled about a boat propeller shaft as the workman uses one hand to hold the halves of said collar against the shaft and the other hand to insert a screw into one of said nuts.

* * * * *